US009784505B2

(12) United States Patent
Olson

(10) Patent No.: US 9,784,505 B2
(45) Date of Patent: Oct. 10, 2017

(54) SYSTEM, APPARATUS, AND METHOD FOR MICRO-CAPILLARY HEAT EXCHANGER

(71) Applicant: Lockheed Martin Corporation—Missiles and Fire Control, Bethesda, MD (US)

(72) Inventor: Jeffrey R. Olson, San Mateo, CA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 198 days.

(21) Appl. No.: 13/894,538

(22) Filed: May 15, 2013

(65) Prior Publication Data

US 2013/0306279 A1 Nov. 21, 2013

Related U.S. Application Data

(60) Provisional application No. 61/647,198, filed on May 15, 2012.

(51) Int. Cl.
*F28D 15/04* (2006.01)
*F28F 21/06* (2006.01)
(Continued)

(52) U.S. Cl.
CPC ..... *F28D 15/046* (2013.01); *F25B 9/02* (2013.01); *F28F 21/06* (2013.01); *F28F 21/062* (2013.01);
(Continued)

(58) Field of Classification Search
CPC ..... F25B 9/02; F25B 19/005; F25B 19/02; F25B 41/06; F25B 41/062; F25B 41/065;
(Continued)

(56) References Cited

U.S. PATENT DOCUMENTS 1,925,934 A 9/1933 Rimstad et al.
2,383,486 A 8/1945 Isenberg et al.
(Continued)

FOREIGN PATENT DOCUMENTS

JP 11-324914 11/1999
JP 4422977 3/2010
(Continued)

OTHER PUBLICATIONS

Esser-Kahn, et al., Three-Dimensional Microvascular Fiber-Reinforced Composites, Advanced Materials, wileyonlinelibrary.com, Wiley-VCH Verlag GmbH & Co. KGaA, Weinheim, 2011, XX, pp. 1-5.

*Primary Examiner* — Christopher R Zerphey
*Assistant Examiner* — Nael Babaa
(74) *Attorney, Agent, or Firm* — Terry M. Sanks, Esquire; Beusse Wolter Sanks & Maire, PLLC

(57) ABSTRACT

A heat exchanger for use with a refrigeration device having a FPA disposed therein being comprised of a polymeric composite mesh material having a hot end and a cold end and defining an array of weft capillaries interwoven with a perpendicular array of warp strands. The array of weft capillaries may include a plurality of high pressure inlet capillaries for channeling and distributing high pressure gas from an inlet at the hot end to a Joule-Thomson orifice at the cold end, a plurality of low pressure outlet capillaries for channeling and distributing high pressure gas from a Joule-Thomson orifice to an outlet of the heat exchanger, and a plurality of low thermal conductivity fibers interspersed between the high pressure inlet capillaries and the low pressure outlet capillaries. In example embodiments. the array of warp strands comprises at least one or more of carbon fibers, copper fibers or glass fibers.

18 Claims, 5 Drawing Sheets

(51) Int. Cl.
*F25B 9/02* (2006.01)
*F28D 7/16* (2006.01)

(52) U.S. Cl.
CPC ..... *F25B 2309/02* (2013.01); *F25B 2309/022* (2013.01); *F28D 7/1615* (2013.01); *F28F 2260/02* (2013.01)

(58) Field of Classification Search
CPC ..... F25B 41/067; F25B 2309/02; F25B 2309/022; F25B 2309/023; F25B 2400/052; F28D 7/0008; F28D 7/0016; F28D 7/0025; F28D 7/003; F28D 7/1615; F28D 15/043; F28D 15/046; F28D 15/0275; F28D 15/04; F28D 2015/0216; F28F 21/06; F28F 21/062; F28F 2260/00
USPC ..... 62/51.2; 250/352
See application file for complete search history.

(56) References Cited

U.S. PATENT DOCUMENTS 3,884,814 A * 5/1975 Vogt et al. ..... 210/321.81
4,392,362 A 7/1983 Little
4,781,033 A * 11/1988 Steyert ..... F17C 3/085 165/10
4,785,879 A * 11/1988 Longsworth ..... F25B 9/02 165/147
4,908,112 A 3/1990 Pace
4,911,846 A * 3/1990 Akasu et al. ..... 210/645
5,249,425 A * 10/1993 Longsworth ..... F25B 9/02 165/10
5,382,797 A * 1/1995 Kunimoto ..... F25B 9/02 250/352
5,758,822 A 6/1998 Yap
5,920,133 A 7/1999 Penswick et al.
6,041,821 A 3/2000 Grossman
6,189,433 B1 2/2001 Harada
6,621,071 B2 * 9/2003 Sobel ..... F17C 13/006 250/214 R
7,883,901 B2 2/2011 Kitazawa et al.
2003/0102435 A1 6/2003 Myers et al.
2004/0123605 A1 7/2004 Pruitt et al.
2005/0112001 A1 5/2005 Bahnen et al.
2005/0230085 A1 * 10/2005 Valenzuela ..... F28D 15/043 165/104.26
2005/0244660 A1 11/2005 Yuasa et al.
2006/0057407 A1 3/2006 Sambasivan et al.
2006/0231237 A1 10/2006 Dangelo
2009/0126373 A1 5/2009 Burg
2009/0258470 A1 10/2009 Choi et al.
2009/0272270 A1 11/2009 McGill et al.
2011/0174467 A1 * 7/2011 Herbst ..... F24F 3/1417 165/104.26
2012/0079838 A1 4/2012 Bin-Nun et al.
2012/0229959 A1 9/2012 Holcomb
2013/0161705 A1 6/2013 Disney et al.
2013/0180862 A1 7/2013 Yoshida et al.

FOREIGN PATENT DOCUMENTS

KR 10-1999-0057578 7/1999
WO 00/53992 9/2000
WO 2013/016224 A1 1/2013

* cited by examiner

SYSTEM, APPARATUS, AND METHOD FOR MICRO-CAPILLARY HEAT EXCHANGER

CROSS REFERENCE TO RELATED APPLICATION(S)

This application claims priority to provisional application Ser. No. 61/647,198, filed May 15, 2012, and entitled "MICROCAPILLARY HEAT EXCHANGER" the contents of which are incorporated in full by reference herein.

FIELD

The embodiments generally relates to systems, apparatus and methods for thermal management devices, and more specifically, to systems, apparatus and methods for a micro-capillary composite material used as a compact and efficient counter-flow heat exchanger.

BACKGROUND

Cryogenic cooling systems are employed in various demanding applications including military and civilian active and remote sensing, superconducting, and general electronics cooling. Such applications often demand efficient, reliable, and cost-effective cooling systems that can achieve extremely cold temperatures below 80 degrees Kelvin.

Efficient cryogenic cooling systems are particularly important in sensing applications involving high-sensitivity infrared focal plane arrays of electromagnetic energy detectors (FPA's). Generally, an FPA may detect electromagnetic energy radiated or reflected from a scene and convert the detected electromagnetic energy into electrical signals corresponding to an image of the scene. To optimize FPA imaging performance, any FPA detector nonuniformities, such as differences in individual detector offsets, gains, or frequency responses, are corrected. Any spatial or temporal variations in temperature across the FPA may cause prohibitive FPA nonuniformities.

FPA's are often employed in avionics applications, particularly missile targeting applications, where weight, size, and spatial and temporal uniformity of cryogenic cooling systems are important design considerations. An FPA should operate at stable cryogenic temperatures for maximum performance and sensitivity.

Conventionally, a cooling fluid was applied to the FPA via a cooling interface. Heat was transferred to the cooling fluid from the FPA. The heated fluid was then expelled from the missile or re-cooled via a heat exchanger integrated into the FPA. The cooling fluid required a heavy and bulky FPA cooling interface and heat exchanger, which were attached to the FPA mounting assembly. Consequently, the FPA assembly required additional mechanical support to secure the interface, heat exchanger, and cooling fluid. The bulky components and additional support hardware oftentimes required additional cooling, which increased demands placed on the cooling system. The bulky support structure, conventionally thought to improve temperature stability, actually reduced system cooling efficiency. Furthermore, the additional bulky mechanical FPA support hardware caused alignment problems with the on board optical or infrared system during installation and operation, thereby increasing installation and operating costs.

Alternatively, Joule-Thompson cryocoolers (or cryostats) have been employed. A Joule-Thomson cryocooler typically applies a regulated flow of cold gas over the infrared FPA.

More specifically, Joule-Thomson cooling occurs when a non-ideal gas expands from high to low pressure at constant enthalpy. The effect can be amplified by using the cooled gas to pre-cool the incoming gas in a heat exchanger. Conventionally, Joule-Thomson heat exchangers have been finned-tube devices or devices made from etched glass such as those manufactured by MMR Technologies, Inc. Disadvantageously, finned tube heat exchangers have a limited heat exchange area and are consequently relatively large and heavy. In addition, glass slide heat exchangers are limited in size and gas flow, which limits the available cooling power. Such conventional methods also incur problems in cost of manufacture.

Undesirably, conventional Joule-Thompson coolers also suffer from relatively short run times because of the size, weight and power penalty associated with a running operation. By increasing the size and weight of the cooler, the additional weight increases the overall operating costs and reduces maneuvering capability and range of the accompanying system. Furthermore, in missile applications, excessive shock or vibration from missile maneuvering may interrupt gas flow, thereby creating potentially prohibitive temperature instabilities, resulting in reduced missile performance.

SUMMARY

The embodiments are designed to overcome the noted shortcomings associated with conventional systems, apparatus, and methods. The embodiments are is also designed to provide a low cost and efficient counter-flow heat exchangers operable for use with Joule-Thomson cooler systems, vapor compression refrigerators, low-noise amplifiers, superconducting electronics, sensors, photodetectors, cryogenic instruments, and the like. In example embodiments, a composite material, counter-flow heat exchanger is provided being fabricated by three-dimensional (3D) weaving of sacrificial fibers into a polymeric matrix, the fibers are subsequently vaporized to obtain a uniform array of capillaries operable for channeling and distributing gases to and from a Joule-Thomson throttle such as an orifice or constructing capillary (hereinafter "Joule-Thomson orifice"). In example embodiments, an array of warp strands having good thermal conductivity (e.g., carbon or copper fibers) are perpendicularly interwoven with the sacrificial fibers. Advantageously, by weaving the sacrificial fibers with a perpendicular array of carbon fibers, good lateral thermal conductance (critical for good counter-flow heat exchange) while retaining low axial conductance (critical for thermally isolating the cold end from ambient temperature) may be achieved. In addition, a micro-capillary array based heat exchanger offers the potential for both large surface area and large gas flow, with a manufacturing process that offers low-cost mass production. Such micro-capillary heat exchangers are also capable of providing 0.5 W cooling at 150K.

Example embodiments provide a heat exchanger comprised of a polymeric composite mesh material having a hot end and a cold end, said composite mesh material defining an array of weft capillaries interwoven with a perpendicular array of warp strands. In example embodiments, the array of weft capillaries may include a plurality of high pressure inlet capillaries for channeling and distributing high pressure gas from an inlet at the hot end to a Joule-Thomson orifice at the cold end and a plurality of low pressure outlet capillaries for channeling and distributing high pressure gas from a Joule-Thomson orifice to an outlet of the heat exchanger. In other example embodiments, the array of weft capillaries further includes a plurality of thermally insulating glass fibers or low thermal conductivity tubes or the like interspersed between the high pressure inlet capillaries and the low pressure outlet capillaries. In example embodiments. the array of warp strands comprises at least one or more of carbon fibers, copper fibers or glass fibers. Example embodiments, provide a heat exchanger that is configured to provide 0.5 W cooling at 150K.

In an example embodiment, a micro-capillary heat exchanger is provided which is manufactured by the process of weaving a plurality of sacrificial weft fibers (approximately 200-1000 microns in diameter) with a perpendicular array of warp strands, infiltrating polymeric material into and about the interwoven sacrificial weft fibers and warp strands, curing the polymeric material, and vaporizing the sacrificial weft fibers to form an array of high pressure inlet capillaries and low pressure outlet capillaries.

An example embodiment provides a micro-capillary heat exchanger for rapidly cooling an infrared (IR) focal plane array (FPA) disposed in an integrated detector cooler assembly (IDCA).

In an example embodiment, an operation of the heat exchanger includes having a gas or refrigerant enter through a high pressure inlet of the heat exchanger and through high pressure capillaries to a Joule-Thomson orifice. The high pressure gas at the cold end flows through a constrictive orifice or capillary, where the pressure drops and the gas cools due to the Joule-Thomson effect. The gas then flows back up the low pressure capillaries of the counter-flow heat exchanger.

Additional features and advantages of the disclosure will be set forth in the detailed description which follows, and in part will be readily apparent to those skilled in the art from that description or recognized by practicing the disclosure as described herein, including the detailed description which follows, the claims, as well as the appended drawings.

It is to be understood that both the foregoing general description and the following detailed description present example embodiments of the disclosure, and are intended to provide an overview or framework for understanding the nature and character of the disclosure as it is claimed. The accompanying drawings are included to provide a further understanding of the disclosure, and are incorporated into and constitute a part of this specification. The drawings illustrate various embodiments of the disclosure, and together with the detailed description, serve to explain the principles and operations thereof.

BRIEF DESCRIPTION OF THE DRAWINGS

The embodiments may take form in various components and arrangements of components, and in various steps and arrangements of steps. The appended drawings are only for purposes of illustrating example embodiments and are not to be construed as limiting the subject matter.

DETAILED DESCRIPTION

The embodiments will now be described more fully hereinafter with reference to the accompanying drawings in which example embodiments are shown. However, this disclosure may be embodied in many different forms and should not be construed as limited to the embodiments set forth herein. These example embodiments are provided so that this disclosure will be both thorough and complete, and will fully convey the scope of the disclosure to those skilled in the art. Like reference numbers refer to like elements throughout the various drawings. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Figure 1:
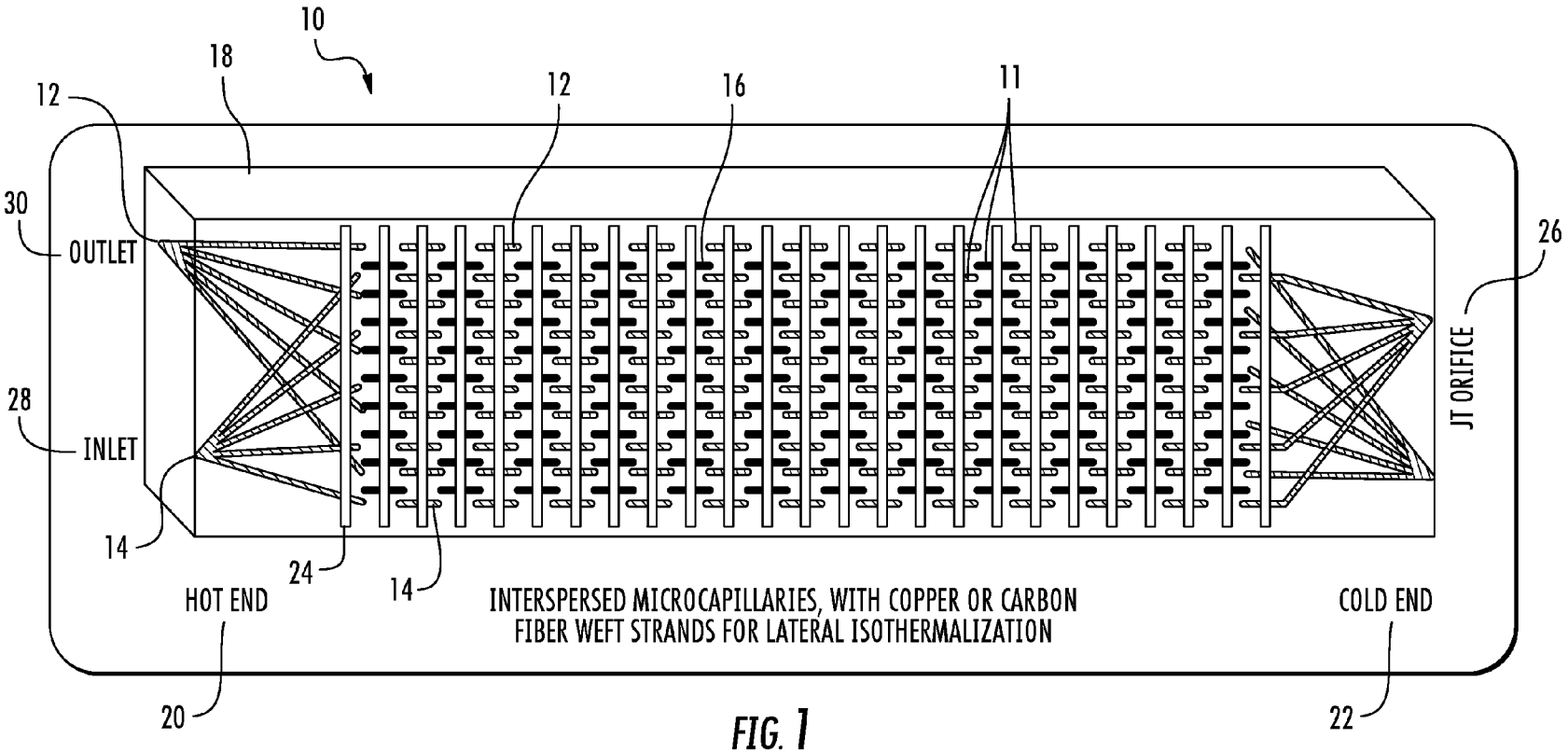
FIG. 1 is a schematic diagram of a heat exchanger in accordance with an embodiment.
Figure 2:
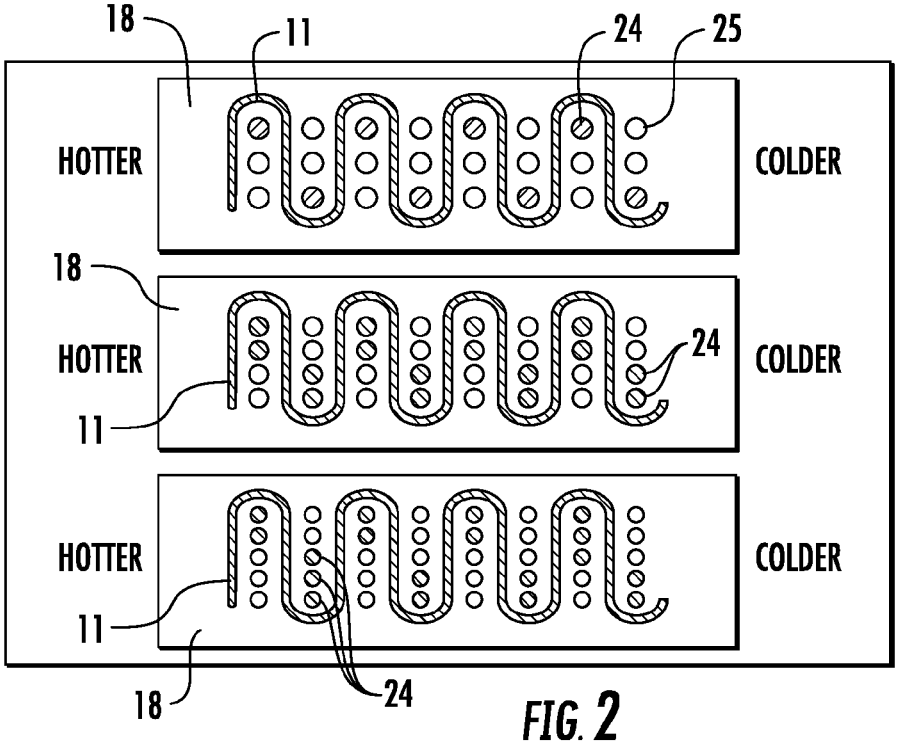
FIG. 2 is a schematic, cross-sectional diagram of a heat exchanger having varying warp strands in accordance with exemplary embodiments.
Figure 3:
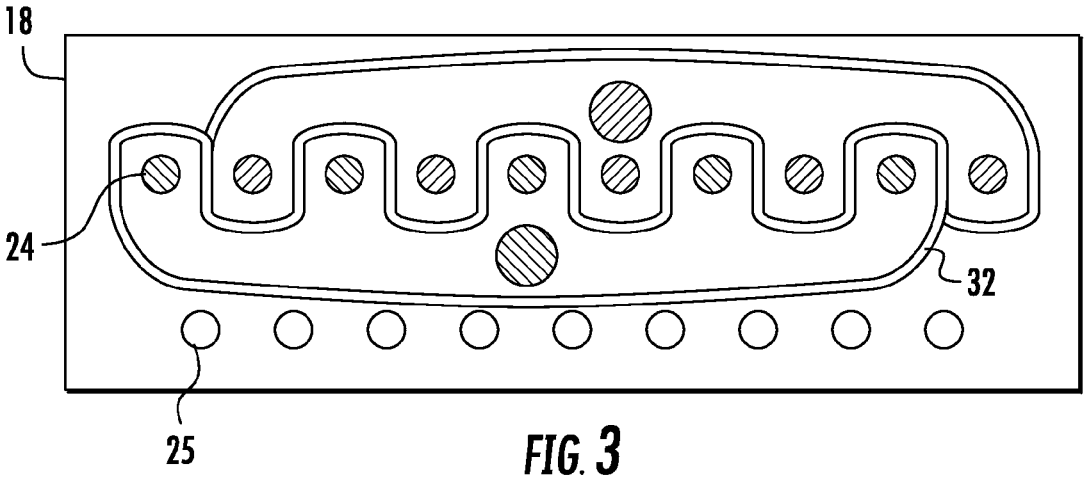
FIG. 3 is a schematic diagram of a heat exchanger in accordance with an embodiment.
Figure 4:
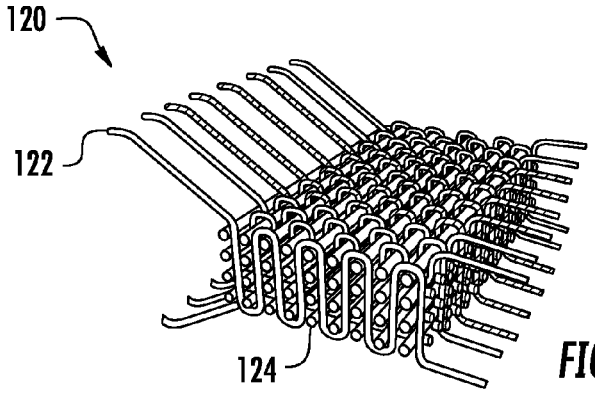
FIG. 4 is an illustrative step in the fabrication process used to implement one or more example embodiments of a heat exchanger.

The embodiments are designed to provide a low cost and efficient counter-flow heat exchangers operable for use with Joule-Thomson cooler systems, Brayton refrigerators, vapor compression refrigerators, low-noise amplifiers, superconducting electronics, sensors, photodetectors, cryogenic instruments, and the like. Example embodiments presented herein disclose systems, apparatus and methods for a micro-capillary heat exchanger operable for use with avionic applications, and more particularly, missile applications, targeting systems and the like. Referring now to the FIGS. 1 and 2, a micro-capillary heat exchanger constructed in accordance with an example embodiment is shown. As illustrated, a heat exchanger 10 is provided and comprises of a polymeric composite mesh material 18 having a hot end 20 and a cold end 22, said composite mesh material 18 defining an array of weft capillaries 11 interwoven with a perpendicular array of warp strands 24. In example embodiments, the array of weft capillaries 11 may include a plurality of high pressure inlet capillaries 14 for channeling and distributing high pressure gas from an inlet 28 at the hot end 20 to a Joule-Thomson orifice 26 at the cold end 22 and a plurality of low pressure outlet capillaries 12 for channeling and distributing low pressure gas from a Joule-Thomson orifice 26 to an outlet 30 of the heat exchanger. In example embodiments, the Joule-Thomson orifice may be replaced with a Brayton expander. In other example embodiments, the array of weft capillaries 11 further include a plurality of thermally insulating glass fibers 16 interspersed between the high pressure inlet capillaries 14 and the low pressure outlet capillaries 12. In example embodiments, the array of warp strands 24 may comprise at least one of carbon fibers, carbon wires, copper fibers or copper wires. In other example embodiments, the array of warp strands 24 may comprise at least one fiber or wire which exhibits good thermal conductivity and at least one fiber or wire which exhibits low or poor thermal conductivity, such as for example a glass fiber. As best shown in FIG. 2, the array of warp strands may have various configurations such as, for example, one carbon fiber and two glass fibers; two carbon fibers and two glass fibers; or two carbon fibers and three glass fibers. Further, in example embodiments, the array of warp strands 24 is four. However, it will be understood by those skilled in the art that any combination and number of warp strands maybe used in order to optimize specified performance criteria. As best shown in FIG. 3, in alternative embodiments the composite mesh material containing capillaries and warp strands may be folded into a manifold type configuration. Example embodiments provide a heat exchanger that is configured to provide 10 mW-10 W cooling at 1K-300K, and preferably 0.5 W cooling at 150K.

In an example embodiment, an operation of the heat exchanger 10 includes having a gas or refrigerant enter through a high pressure inlet port 28 of the heat exchanger 10 and through high pressure capillaries 14 to a Joule-Thomson orifice. The high pressure gas at the cold end flows through a constrictive orifice or capillary, where the pressure drops and the gas cools due to the Joule-Thomson effect. The gas then flows back up the low pressure capillaries 12 of the counter-flow heat exchanger 10 to an outlet port 30.

Referring now to FIGS. 4-8, a method of fabrication 100 of the heat exchanger 10 is provided. As shown, the method of fabrication 100 begins with a determination of the geometric boundaries of a desired mesh composite for incorporation into a specific application such as an IDCA (Step 110). At Step 120, a three dimensional (3D) weave matrix is formed by mechanically weaving an array of sacrificial weft fibers 122 with a perpendicular array of warp strands 124 (See, FIG. 4). The predetermined geometric boundaries, the position, length, diameter, and curvature of sacrificial weft fibers 122 may be varied to meet the heat exchange application. Although mechanized weaving is disclosed herein, other types of weaving suitable for generating the 3D weave matrix described herein may be employed. Further, in example embodiments, the diameter of the sacrificial weft strands 122 may be in the range of 10-1000 microns.

Figure 5:
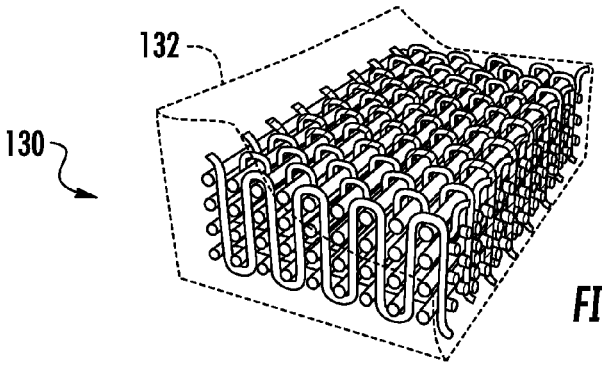
FIG. 5 is an illustrative step in the fabrication process used to implement one or more example embodiments of a heat exchanger.
Figure 6:
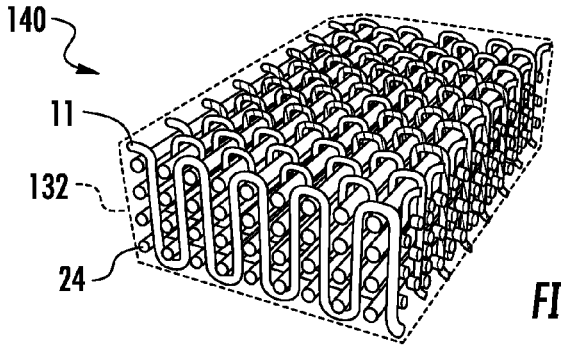
FIG. 6 is an illustrative step in the fabrication process used to implement one or more example embodiments of a heat exchanger.

At Step 130, the interstitial pore space between the sacrificial weft fibers 122 and the warp strands 124 are infiltrated with a polymeric material 132 (See, FIG. 5). In example embodiments, the polymeric material 132 is a low-viscosity thermosetting resin (e.g., epoxy) however; other suitable polymeric materials may be utilized. Further, in example embodiments, the infiltration is facilitated by vacuum assisted resin transfer molding (VARTM) however, it will be appreciated by those skilled in the art that any manner of infiltrating the polymeric material into the interstitial pore space may be employed.

At Step 140, the polymeric material 132 is cured and the ends are trimmed to expose portions of the sacrificial weft fibers 122. (See, FIG. 6) In example embodiments, the polymeric material is cured at an elevated temperature. In example embodiments, the polymeric material 132 is trimmed to be shaped into a generally planar, rectangular form. It will be appreciated by those skilled in the art, that other suitable shapes and forms may be created to meet design criteria.

Figure 7:
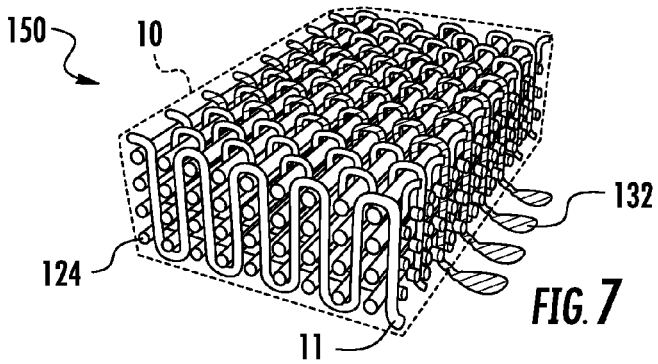
FIG. 7 is an illustrative step in the fabrication process used to implement one or more example embodiments of a heat exchanger.
Figure 8:
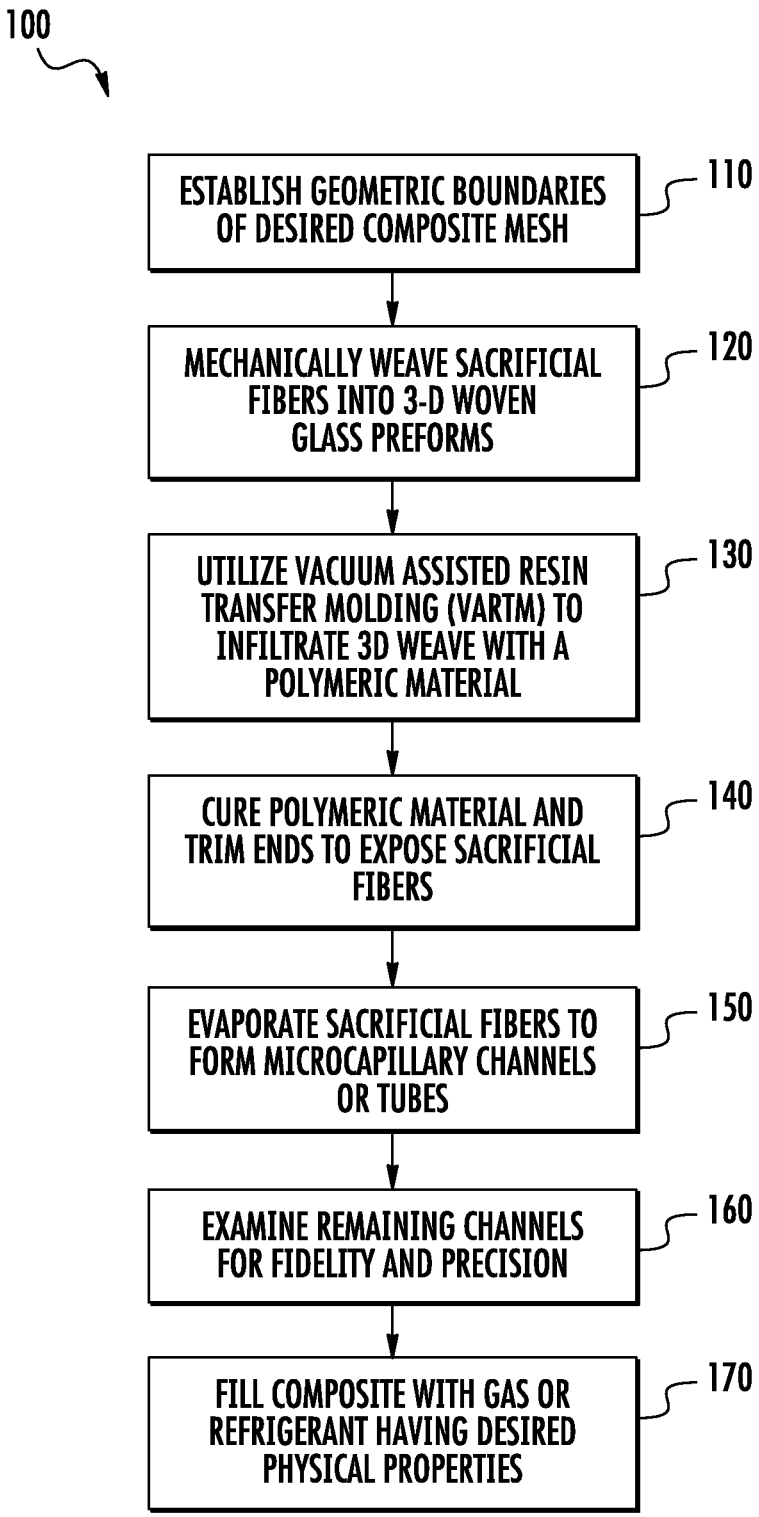
FIG. 8 is a flowchart of an overall example method of fabrication of a heat exchanger in accordance with an embodiment.

At Step 150, the sacrifice weft fibers 122 are then removed by heating the sample to above 200° C. to vaporize the sacrificial weft fibers 122, yielding an array of empty channels or capillaries 11 and a 3-D network or mesh 10 throughout the composite (See, FIG. 7).

At Step 160, the newly formed composite mesh 10 is inspected for both fidelity and precision. Thereafter, the mesh 10 is incorporated into a specified application, such as an IDCA, and the composite is then filled with a gas or refrigerant having the desired physical properties so that the gas is channeled through the capillaries 11 to a Joule-Thomson orifice and back such that cooling occurs (Step 170).

The sacrificial weft fibers 122 should satisfy several criteria. For example, the fiber may be selected to be strong enough to survive the mechanical weaving and infiltration process. Additionally, for the creation of complex geometries and large length-to-diameter aspect ratios, the fiber may remain solid during curing (e.g., up to 180° C.), but then be easily removed via vaporization.

In example embodiments the sacrificial weft fibers 122 are a thermoplastic that vaporizes or depolymerizes into gaseous lactide monomers at temperatures above 280° C. In certain embodiments, the depolymerization temperature may be lowered by the addition of metal catalysts such as tin oxalate (SnOx). It is known that catalyst-treated fibers convert to gas at a lower temperature and in less time as measured by isothermal gravimetric analysis (iTGA) indicating a lower depolymerization onset temperature. When incorporated into the polymeric material, the sacrificial weft fibers 122 are removed by heating at 200° C. for several hours. At this temperature, the fibers begin to melt and then produce gas bubbles that expel liquid out of the capillary ends leaving residual material to evaporate, finally resulting in complete clearing of the capillary. Fiber removal may occur over the period of 24 h, with 95% of the material removed in less than 6 h. The disclosed process of fabrication is capable of producing a range of capillary curvatures and diameters. Capillaries ranging in size from 10-1000 μm can be created in epoxy matrices following fiber clearing.

Figure 9:
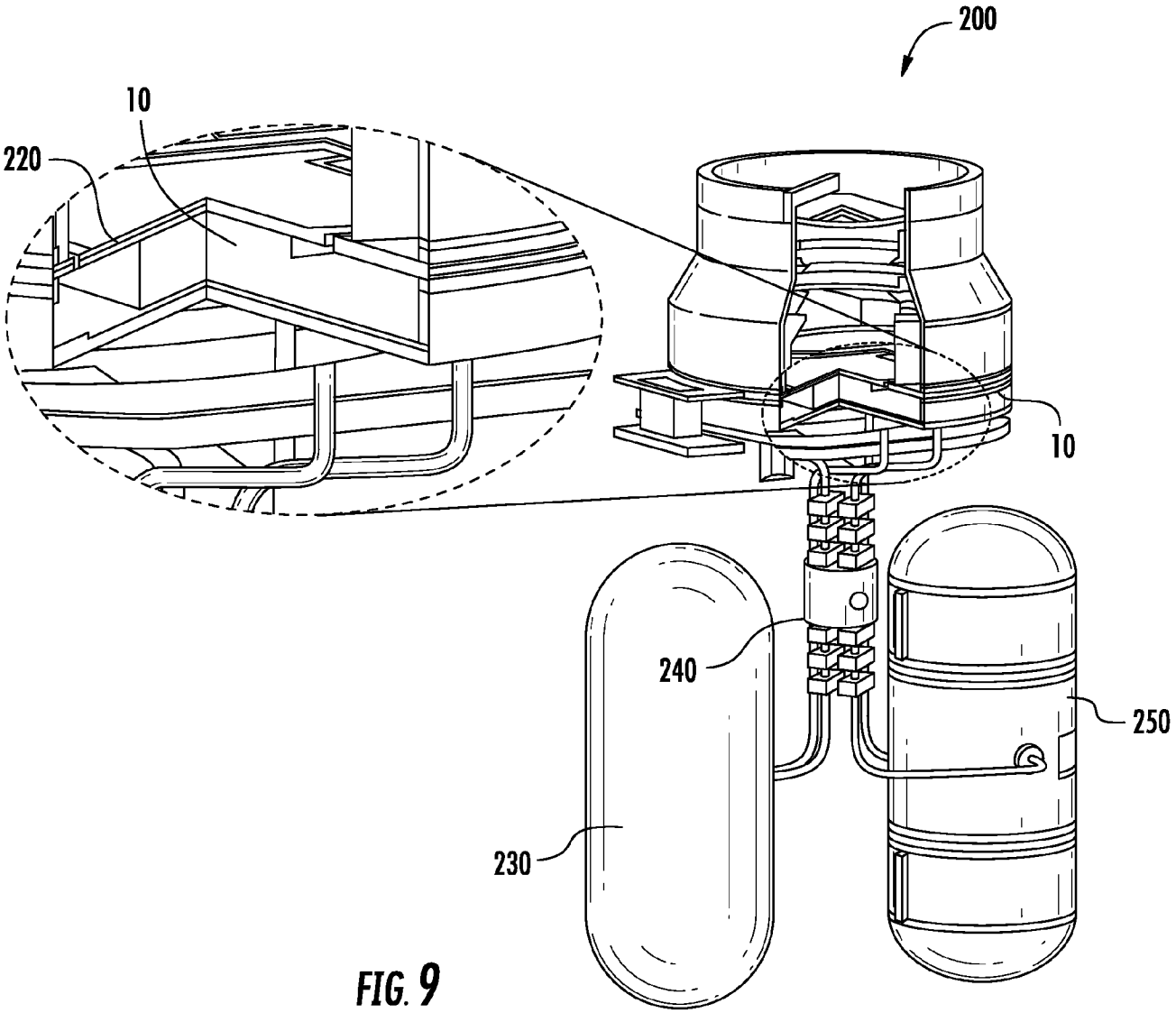
FIG. 9 is a schematic diagram of an IDCA incorporating an FPA and a heat exchanger according to one exemplary embodiment.

In exemplary embodiments, once the heat exchanger 10 is fabricated it may be incorporated into an IDCA 200 with an FPA 220 disposed therein for the purpose of rapidly cooling the FPA 220. Referring now to FIG. 9, an example embodiment of an IDCA 200 incorporating an FPA 220 and a micro-capillary heat exchanger 10 is shown. As shown, the IDCA 200 includes a housing 201 for maintaining an FPA 220 which is disposed on a heat exchanger 10 therein. The IDCA 200 may be connected to a gas pressure bottle 230 or compressor 250 or both via a diverter manifold 240, the gas bottle 230 having at least one gas contained therein. The gas may be any one or more of methane, ethane, argon, isobutene, nitrogen, propane, or mixtures thereof which are suitable for cooling systems. When the FPA 220 is activated, the diverter manifold 240 may be engaged or switched over to open-loop operation such that the gas from the gas pressure bottle 230 quickly cools the FPA 220 through the heat exchanger 10. In some variations, an FPA 220 may reach a desired operating temperature within ten seconds or less.

When a desired operating temperature is achieved, the diverter manifold 240 may be switched over to a closed-loop operation, stopping the flow of gas from the gas pressure bottle 230 and engaging the compressor 250, which activates to maintain the FPA 220 at the desired operating temperature without a further significant loss of gas. Although not preferred for quickly cooling an FPA 220 to a desired operating temperature, a closed-loop compressor-based 250 cooling system enables the heat exchanger 10 to maintain the FPA 220 at the desired operating temperature for a relatively long period of time. In some cases, compressor-based cooling can allow for extended ongoing operation of an infra-red FPA 220 for up to an hour or longer.

In example embodiments, where the FPA 220 is intended for a single-use application, such as a missile seeker or a targeting feature of a single-use or limited-use weapon or device, the diverter 240 and/or charge port may be omitted. In further example embodiments, the diverter manifold 240 may be replaced with a different type of switch or switching paradigm, such as one or more valves.

Advantageously, the disclosed systems, apparatus and methods for micro-capillary heat exchanger offers low-cost manufacturing with precision control over the generation of the capillary passages which can be tailored to specific cooling requirements, and offers the capability to incorporate high-performance materials such as carbon fibers for excellent thermal characteristics. The capillary diameters can be tailored within a range (approximately 10-1000 microns) which provides a large amount of surface area for heat exchange between two counter-flowing gas streams. This configuration provides good heat exchanger effectiveness, which is critical for high-efficiency refrigeration. Incorporating carbon fibers or copper wires into the "warp" of the weave allows one to add excellent lateral thermal conduction, which is necessary for good counter-flow heat exchange, while still maintaining low axial thermal conduction, which is important because there is a large temperature gradient in the axial direction. Still further, the micro-capillary composite heat exchanger offers more heat exchange area between the gas and solid, allowing it to be made more compact than a finned-tube heat exchanger. It offers a much larger gas flow area than glass slide heat exchangers, offering larger overall cooling capacity. Furthermore, the parallel nature of the gas channels makes this technology extremely simple to scale in size to tailor it for specific cooling applications.

The embodiments described above provide advantages over conventional devices and associated systems and methods. It will be apparent to those skilled in the art that various modifications and variations can be made to the embodiments without departing from the spirit and scope of the disclosure. Thus, it is intended that the disclosure cover the modifications and variations of this disclosure provided they come within the scope of the appended claims and their equivalents. Furthermore, the foregoing description of the embodiments and best mode for practicing the disclosure are provided for the purpose of illustration only and not for the purpose of limitation—the disclosure being defined by the claims.

What is claimed is:

1. A micro-capillary heat exchanger, comprising: a composite mesh material having a geometric shape, a hot end and a cold end, said composite mesh material comprising a polymeric material defining an array of weft capillaries formed in the polymeric material for channeling a refrigerant to perform a heat exchange application and a perpendicular array of warp strands in the polymeric material, said array of weft capillaries being interwoven according to a weft curvature with the perpendicular array of warp strands wherein the array of warp strands comprises at least one of fiber or wire having a thermal conductivity for the heat exchange application of a cyrocooler, wherein the polymeric material fills interstitial space between the array of weft capillaries and the perpendicular array of warp strands bounded by the geometric shape.

2. The micro-capillary heat exchanger of claim 1, wherein the polymeric material comprises an epoxy resin.

3. The micro-capillary heat exchanger of claim 1, further comprising an inlet and an outlet;

wherein the array of weft capillaries comprises:

a plurality of inlet capillaries for channeling and distributing refrigerant from the inlet at the hot end to a Joule-Thomson orifice at the cold end; and a plurality of outlet capillaries for channeling and distributing refrigerant from a Joule-Thomson orifice to the outlet of the heat exchanger.

4. The micro-capillary heat exchanger of claim 3, wherein the array of weft capillaries further comprising a plurality of thermally insulating glass fibers in the polymeric material and being interspersed between the plurality of inlet capillaries and the plurality of outlet capillaries.

5. The micro-capillary heat exchanger of claim 1, wherein the at least one of fiber or wire having the thermal conductivity comprises at least one of carbon fibers and copper fibers.

6. The micro-capillary heat exchanger of claim 1, wherein the thermal conductivity is a first thermal conductivity; and the array of warp strands comprises at least one of fiber or wire having a second thermal conductivity wherein the second thermal conductivity is lower than the first thermal conductivity wherein the array of warp strands provides lateral thermal conduction.

7. The micro-capillary heat exchanger of claim 1, wherein the heat exchanger is a planar, Joule-Thomson heat exchanger.

8. The micro-capillary heat exchanger of claim 1, wherein the heat exchanger is configured to provide 0.5 W cooling at 150K.

9. The micro-capillary heat exchanger of claim 1, wherein the array of weft capillaries having a diameter of approximately 10-1000 microns.

10. The micro-capillary heat exchanger of claim 1, wherein the array of capillaries comprises at least four capillaries.

11. A micro-capillary heat exchanger for rapidly cooling a focal plane array (FPA) disposed within an integrated detector cooler assembly (IDCA), comprising:

a cold end located proximate to a Joule-Thomson orifice;

a hot end located proximate a source of refrigerant, the cold end and the hot end being separated by a defined dimension; and means for conducting a refrigerant from the hot end to the Joule-Thomson orifice and for conducting a refrigerant from the Joule-Thomson orifice to the hot end, said means comprising a composite mesh material having a geometric shape and being connected to the FPA, the composite mesh material comprising a polymeric material defining an array of weft capillaries to channel the refrigerant and the refrigerant to perform a heat exchange application interwoven according to a weft curvature with a perpendicular array of warp strands in the polymeric material, wherein the polymeric material fills interstitial space between the array of weft capillaries and the perpendicular array of warp strands bounded by the geometric shape.

12. The micro-capillary heat exchanger of claim 11, further comprising an inlet and an outlet; wherein the array of weft capillaries comprises:

a plurality of inlet capillaries for channeling and distributing the refrigerant from the inlet at the hot end to the Joule-Thomson orifice at the cold end; a plurality of outlet capillaries for channeling and distributing the refrigerant from the Joule-Thomson orifice to the outlet of the heat exchanger; and a plurality of thermally insulating glass fibers interspersed between the inlet capillaries and the outlet capillaries.

13. The micro-capillary heat exchanger of claim 11, wherein the array of warp strands comprises one or more of carbon fibers, carbon wires, copper wires, or copper fibers.

14. The micro-capillary heat exchanger of claim 11, wherein the array of warp strands comprises at least one of fiber or wire having a first thermal conductivity and at least one fiber or wire having a second thermal conductivity wherein the second thermal conductivity is lower than the first thermal conductivity wherein the array of warp strands provides lateral thermal conduction.

15. The micro-capillary heat exchanger of claim 12, wherein the array of weft capillaries further comprises a plurality of thermally insulating glass fibers interspersed between the inlet capillaries and the outlet capillaries.

16. A micro-capillary heat exchanger, comprising:

a composite mesh material having a geometric shape, a hot end and a cold end, said composite mesh material comprising a polymeric material defining an array of weft capillaries for channeling a refrigerant to perform a heat exchange application and a perpendicular array of warp strands in the polymeric material, said array of weft capillaries being interwoven according to a weft curvature with the perpendicular array of warp strands and the polymeric material fills interstitial space between the array of weft capillaries and the perpendicular array of warp strands bounded by the geometric shape;

an inlet; and an outlet wherein the array of weft capillaries comprises:

a plurality of inlet capillaries defined in the polymeric material for channeling and distributing refrigerant from the inlet at the hot end to a Joule-Thomson orifice at the cold end;

a plurality of outlet capillaries defined in the polymeric material for channeling and distributing refrigerant from a Joule-Thomson orifice to the outlet of the heat exchanger; and a plurality of thermally insulating glass fibers in the polymeric material and being interspersed between the inlet capillaries and the outlet capillaries; and the array of warp strands comprises:

at least one of fiber or wire having a first thermal conductivity; and at least one fiber or wire having a second thermal conductivity which is lower than the first thermal conductivity wherein the array of warp strands provides lateral thermal conduction.

17. The micro-capillary heat exchanger of claim 16, wherein the heat exchanger is a counter-flow heat exchanger.

18. The micro-capillary heat exchanger of claim 11, wherein the heat exchanger is a counter-flow heat exchanger.

* * * * *